US007997651B2

(12) United States Patent
Shen

(10) Patent No.: US 7,997,651 B2
(45) **Date of Patent: *Aug. 16, 2011**

(54) KNOCKDOWN CHAIR HAVING REINFORCED SIDE SUPPORTS

(76) Inventor: Ziming Shen, Staten Island, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/806,242

(22) Filed: Aug. 6, 2010

(65) Prior Publication Data

US 2010/0301657 A1 Dec. 2, 2010

Related U.S. Application Data

(63) Continuation of application No. 12/074,625, filed on Mar. 4, 2008, now Pat. No. 7,775,590.

(51) Int. Cl.
*A47C 3/00* (2006.01)

(52) U.S. Cl. ..... 297/287; 297/259.4; 297/288; 297/289; 297/290; 297/411.28; 297/411.42; 297/440.1; 297/440.23; 297/452.13

(58) Field of Classification Search ..... 297/259.4, 297/287, 288–290, 295, 411.28, 411.42, 297/411.44, 440.1, 440.14, 440.23, 448.2, 297/451.8, 452.13
See application file for complete search history.

(56) References Cited

U.S. PATENT DOCUMENTS

| | | | | | |
|---|---|---|---|---|---|
| 1,025,038 | A | * | 4/1912 | Wilkening | 297/287 |
| 2,006,421 | A | * | 7/1935 | Trainor | 297/287 |
| 2,034,412 | A | * | 3/1936 | Neutra | 248/598 |
| 2,080,607 | A | * | 5/1937 | Galante | 297/287 |
| 2,135,586 | A | * | 11/1938 | Lorenz et al. | 297/287 |
| 2,135,833 | A | * | 11/1938 | Oermann | 297/287 |
| 2,215,540 | A | * | 9/1940 | Breuer | 297/287 |
| 2,264,143 | A | * | 11/1941 | Scott et al. | 297/288 |
| 2,273,980 | A | * | 2/1942 | Moody | 297/287 |
| 2,303,039 | A | * | 11/1942 | Gilklson | 297/411.42 |
| 2,426,676 | A | * | 9/1947 | Fleischer | 297/411.42 |
| 2,521,422 | A | * | 9/1950 | Strand, Jr. | 297/130 |
| 2,564,915 | A | * | 8/1951 | Nelson | 297/287 |
| 2,638,149 | A | * | 5/1953 | Janosek | 297/411.42 |
| 2,718,916 | A | * | 9/1955 | Borochoff | 297/287 |
| 3,836,194 | A | * | 9/1974 | Milette et al. | 297/55 |
| D248,259 | S | | 6/1978 | Lande | |
| D250,074 | S | | 10/1978 | Petersen | |
| 4,410,214 | A | * | 10/1983 | Geschwender | 297/118 |
| D276,484 | S | | 11/1984 | Kramer et al. | |
| 4,660,884 | A | * | 4/1987 | Terui et al. | 297/317 |
| D295,586 | S | | 5/1988 | Conn | |
| 4,911,500 | A | * | 3/1990 | Saiger | 297/287 |
| 4,938,530 | A | * | 7/1990 | Snyder et al. | 297/287 |
| 5,071,191 | A | * | 12/1991 | Leib | 297/451.1 |
| D335,042 | S | | 4/1993 | Gibbs | |

(Continued)

*Primary Examiner* — Laurie K Cranmer
(74) *Attorney, Agent, or Firm* — Alfred M. Walker; Harvey Lunenfeld

(57) ABSTRACT

An improved knockdown chair having opposing substantially C shaped support arms, substantially L shaped tubular seating arrangement, sock type seating portion cover, front reinforcing member, and bottom reinforcing member, wherein each of the opposing substantially C shaped support arms are of laminate construction and have an upper arcuate arm support, front arcuate portion, and substantially straight bottom, the substantially L shaped tubular seating arrangement having a tubular seat back and tubular sitting portion telescopically interconnected one to the other, and wherein each of the opposing substantially C shaped support arms is opposingly removably fastened to the substantially L shaped tubular seating arrangement, the improvement comprising combination with each of the opposing substantially C shaped support arms of a substantially S shaped reinforcing member of laminate construction removably fastened to the upper arcuate arm support and the substantially straight bottom for reinforcing each of the opposing substantially C shaped support arms.

10 Claims, 6 Drawing Sheets

U.S. PATENT DOCUMENTS 5,503,458 A * 4/1996 Petrie ..... 297/452.13
5,507,563 A * 4/1996 Arthur, Jr. ..... 297/440.23
5,516,196 A * 5/1996 Forslund et al. ..... 297/286
5,695,244 A * 12/1997 Gillern et al. ..... 297/271.6
D438,720 S 3/2001 Neil
6,224,159 B1 * 5/2001 Perry ..... 297/440.1
6,450,575 B1 * 9/2002 Liu ..... 297/239
7,775,590 B2 * 8/2010 Shen ..... 297/287

* cited by examiner 10
12
14
16
22
24
26
32
34
4

110
116
122
124
112
126
114
132

132
134

110
116
113
9
122
124
112
126
113
114
132

KNOCKDOWN CHAIR HAVING REINFORCED SIDE SUPPORTS

RELATED APPLICATIONS

This application is a continuation of application Ser. No. 12/074,625, filed Mar. 4, 2008 now U.S. Pat. No. 7,775,590 and claims priority therefrom under 35 USC §120.

BACKGROUND OF THE INVENTION

1. Field of the Invention

The present invention relates generally to seating arrangements and more particularly to knockdown chairs.

2. Background Art

Knockdown chairs having a pair of opposing semi-rigid or semi-flexible substantially C shaped side members have been known. These chairs have typically have armrests formed at an upper portion of the substantially C shaped side members. The substantially C shaped side members are typically structural elements held in place by fastening the side members substantially C shaped side members to a seating portion, and using bottom reinforcing member toward the rear and bottom front laterally extending between the substantially C shaped side members. The seating portion may comprise a separate light weight tubular or wooden frame encased in a taut fabric sock. The fabric encased frame may then be covered with an optional fabric cushion or the optional fabric cushion may be added for additional seating comfort.

This construction is ideal for a kit, easily assembled by a customer; packaging of the structural portion of the kit in convenient flat box is facilitated by the design selected. When a person is seated on this chair, the side members flex slightly, while supporting the person's weight. It is this flexing that contributes to the comfort afforded.

Scaling down such a knockdown chair for use by children has exposed a problem not encountered in typical adult use of similar chairs. Adults are usually careful when sitting down, and do not present sudden shock loads to the semi rigid or semi flexible side members. Children often bounce up and down on a chair, as a means of play, or suddenly pounce down on the chair, as they sit on the chair. Friends may jump on their laps. Also, other children may sit on the top portion of the side members, which otherwise just serve as armrests. These non-traditional juvenile use modes can cause the side members to fracture and/or break. A strut between the open ends of the substantially C-shaped side members would solve the problem of adding strength to the side members, while still maintaining some degree of semi-rigidity of semi-flexibility and allowing a limited amount of flexing.

Additionally, ASTM standard number F963 for children's chairs require that the chair be constructed to resist downward force, such as by a jumping or bouncing child.

The improved knockdown chair of the present invention is constructed so as to meet ASTM Standard number F963 regarding the knockdown chair being constructed to resist an application of force being exerted upon the knockdown chair by a bouncing child, which resistance exceeds the typical force of a bouncing child upon improved knockdown chair.

For the foregoing reasons, there is a need for a knockdown chair having reinforced side supports. The reinforced side supports should be simple to install either during initial assembly of the knockdown chair or as a retrofit to be installed after the chair has been assembled and already in use. Reinforcements in the form of struts should be durable, light weight, inexpensive, safe to use, attractive, sturdy, and of simple construction.

SUMMARY

The present invention is directed to a knockdown chair having reinforced side supports. The reinforced side supports are simple to install either during initial assembly of the knockdown chair or as a retrofit to be installed after the chair has been assembled and already in use. Reinforcements in the form of struts should be durable, light weight, inexpensive, safe to use, attractive, sturdy, and of simple construction.

To reinforce the side members of a scaled down chair of this invention, an elongated curved spring type strut or member may be used, which may be attached to the substantially C shaped side members at the top armrest portion and the bottom base portion of the substantially C shaped side members. This elongated curved spring type strut or member may be substantially S shaped or substantially C shaped, or may be of another suitable shape, and may be used to support the armrest top portion of the side members by transferring load to the base portion, while still affording some degree of flexibility and springiness to the knockdown chair.

The substantially S shaped or substantially C shaped spring type of strut, or other suitable reinforcing strut or member, greatly enhances the load bearing and load-carrying capability of the side members, and, thus, the knockdown chair, without detracting from the curved aesthetic nature of the original design. With the substantially S shaped or substantially C shaped spring type of strut, or other suitable reinforcing strut or member, the armrest deflects to a lesser degree than without the substantially S shaped or substantially C shaped spring type of strut, or other suitable reinforcing strut or member, but enhances the knockdown chair's load bearing and load carrying capacity.

Preferably the substantially S shaped or substantially C shaped spring type of strut, or other suitable reinforcing strut or member, are each made of laminations, i.e., a plurality of laminate plys held together by resin or glue. The laminations combined with the resin or glue promote strength, while maintaining a degree of rigidity and flexibility of the substantially S shaped or substantially C shaped spring type of strut, or other suitable reinforcing strut or member, and, thus, improve comfort, load bearing and load-carrying capacity, and performance of the substantially C shaped side members and the knockdown chair.

The laminations, thus, improve load bearing and load carrying capacity of the improved knockdown chair, while maintaining a degree of rigidity and flexibility necessary for comfort, and result in better strength, performance, rigidity, flexibility, and resistance to fracture than such substantially S shaped or substantially C shaped reinforcements and/or other struts without such laminations. The laminated curved panel plys distribute the flexure better than if formed from a solid piece of wood.

The preferred embodiment uses a bent wood substantially S shaped or substantially C shaped spring type of strut, or other suitable reinforcing strut or member. An alternate embodiment may use a curved metal spring, which can be alternately be fabricated of flat steel or brass stock, which may be tempered after forming. An alternate embodiment for the tubular frame members can be frame members which are releasably interconnectable elongated wooden, plastic or metal frame posts. In a further alternate embodiment, the lamination may contain one or more internal metal core laminate ply layers between adjacent wooden laminate ply layers.

In a knockdown chair having opposing substantially C shaped support arms, a substantially L shaped tubular seating arrangement, a sock type seating portion cover, a front reinforcing member, and a bottom reinforcing member, wherein each of the opposing substantially C shaped support arms are of laminate construction and have an upper arcuate arm support, a front arcuate portion, and a substantially straight bottom, the substantially L shaped tubular seating arrangement having a tubular seat back and a tubular sitting portion telescopically interconnected one to the other, the sock type seating portion cover removably fitted about the substantially L shaped tubular seating arrangement, and wherein each of the opposing substantially C shaped support arms is opposingly removably fastened to the substantially L shaped tubular seating arrangement, the front reinforcing member and the bottom reinforcing member each removably fastened to and therebetween the opposing substantially C shaped support arms, the combination having features of the present invention with each of the opposing substantially C shaped support arms of a substantially S shaped reinforcing member of laminate construction removably fastened to the upper arcuate arm support and the substantially straight bottom for reinforcing each of the opposing substantially C shaped support arms.

DRAWINGS

These and other features, aspects, and advantages of the present invention will become better understood with regard to the following description, appended claims, and accompanying drawings where:

DESCRIPTION

The preferred embodiments of the present invention will be described with reference to FIGS. 1-10 of the drawings. Identical elements in the various figures are identified with the same reference numbers.

Figure 1:
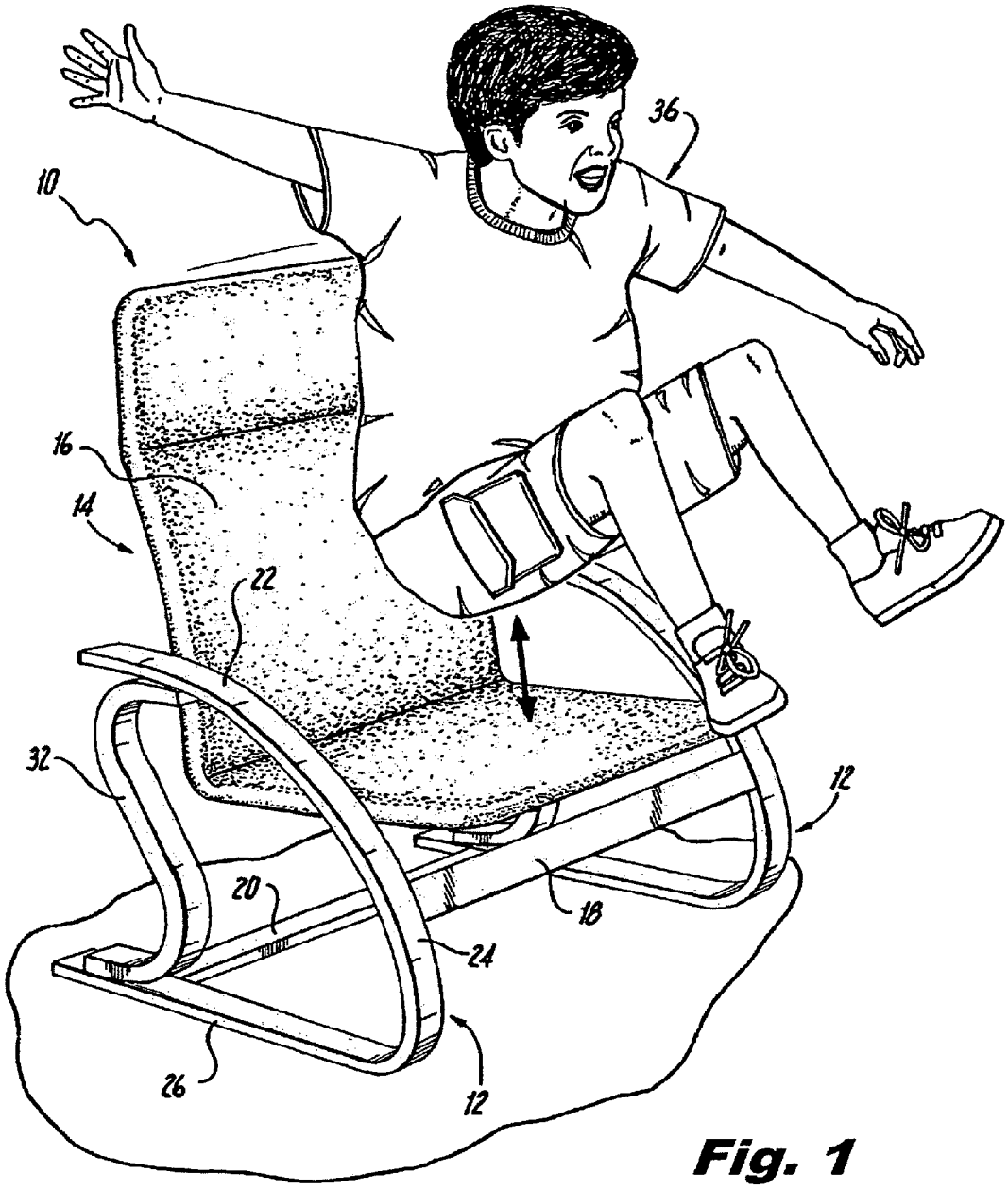
FIG. 1 is a perspective view of an improved knockdown chair, constructed in accordance with the present invention, and a child bouncing on the improved knockdown chair.
Figures 2, 3, 4:
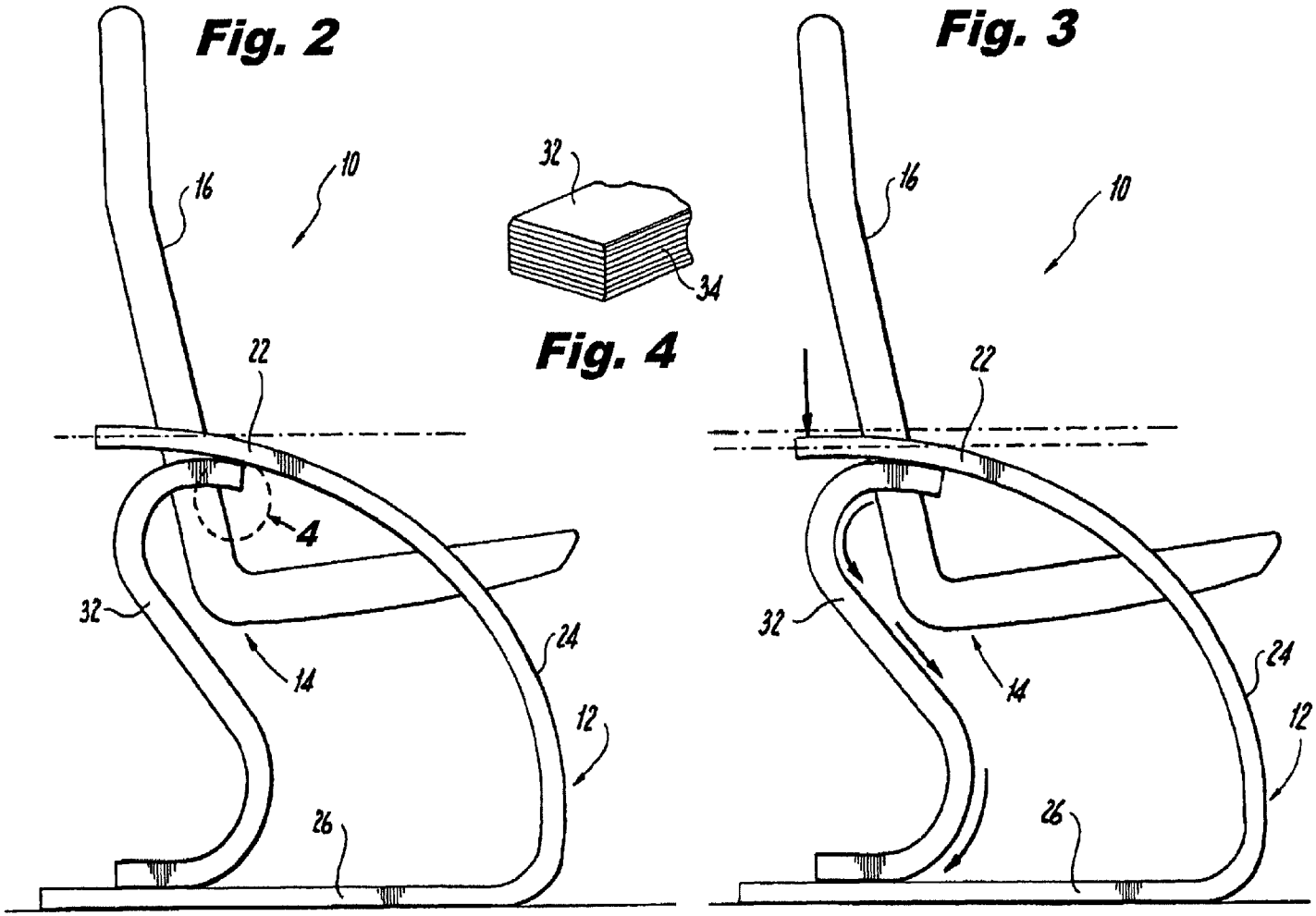
FIG. 2 is a side view of the improved knockdown chair of FIG. 1.
FIG. 3 is a side view of the improved knockdown chair of FIG. 1 showing the improved knockdown chair under load bearing conditions.
FIG. 4 is a perspective view of a corner of a reinforcing member of the improved knockdown chair of FIG. 1 showing laminations of a reinforcing member
Figure 5:
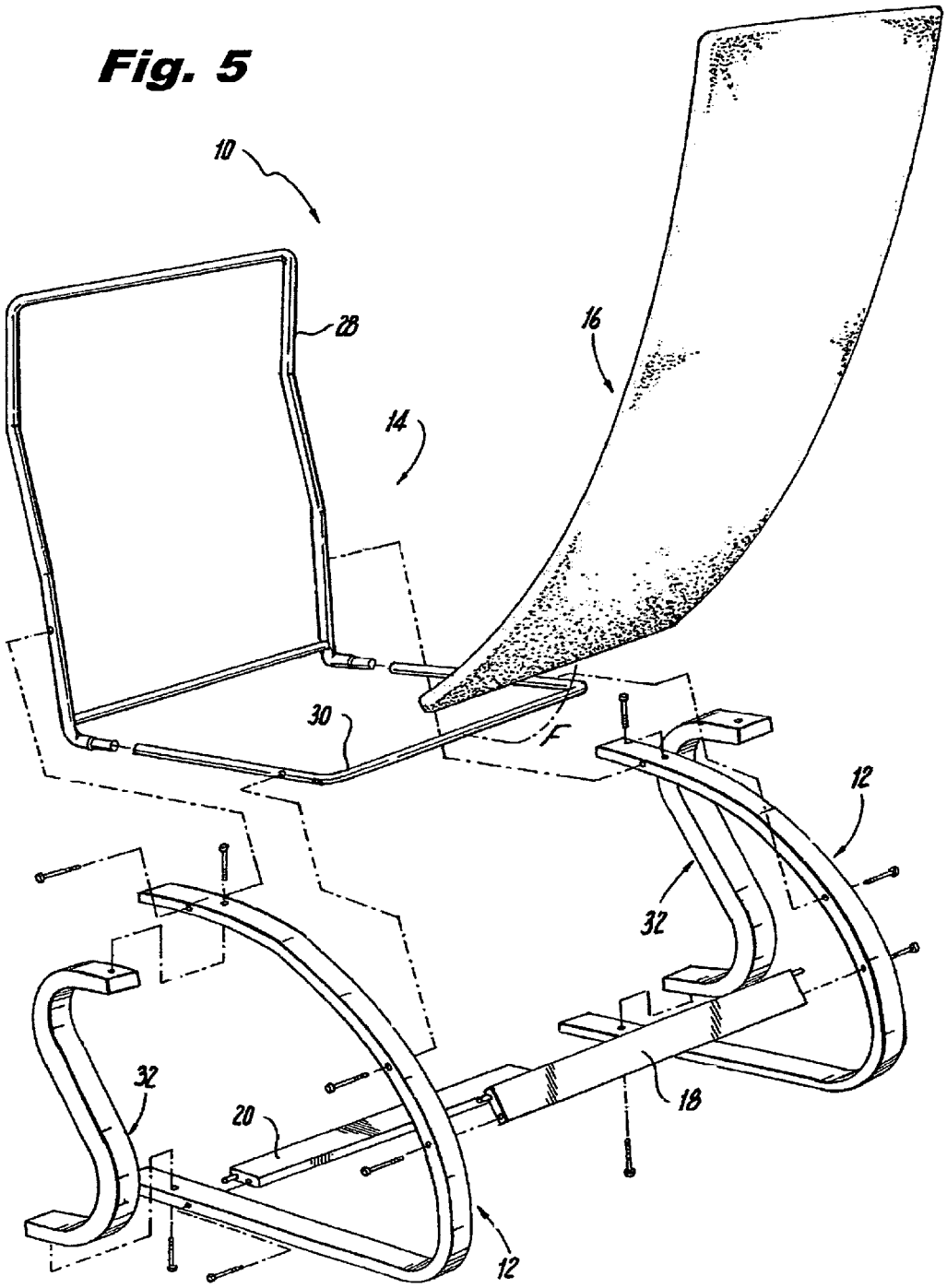
FIG. 5 is an exploded view of the improved knockdown chair of FIG. 1.

FIGS. 1-5 show an embodiment of the present invention, an improved knockdown chair 10 has opposing substantially C shaped support arms 12, a substantially L shaped tubular seating arrangement 14, a sock type seating portion cover 16, a front reinforcing member 18, and a bottom reinforcing member 20, wherein each of the opposing substantially C shaped support arms 12 are of laminate construction and have an upper arcuate arm support 22, a front arcuate portion 24, and a substantially straight bottom 26, the substantially L shaped tubular seating arrangement 14 having a tubular seat back 28 and a tubular sitting portion 30 telescopically interconnected one to the other, the sock type seating portion cover 16 removably fitted about the substantially L shaped tubular seating arrangement 14, and wherein each of the opposing substantially C shaped support arms 12 is opposingly removably fastened to the substantially L shaped tubular seating arrangement 14, the front reinforcing member 18 and the bottom reinforcing member 20 each removably fastened to and therebetween the opposing substantially C shaped support arms 12, wherein the improvement comprises the combination with each of the opposing substantially C shaped support arms 12 of the substantially S shaped reinforcing member 32 of laminate construction removably fastened to the upper arcuate arm support 24 and the substantially straight bottom 26 for reinforcing each of the opposing substantially C shaped support arms 12. FIG. 4 shows laminations 34 of the substantially S shaped reinforcing member 32. Child 36 is shown bouncing on the improved knockdown chair 10 in FIG. 1.

Child 36 is shown bouncing on the improved knockdown chair 10 in FIG. 1.

FIG. 3 shows a maximum permissible deflection as indicated by the arrow and dashed lines as the arcuate arm support 22 bends in the amount shown in dashed lines, when subject to downward force, such as by child 36 jumping or bouncing on the improved knockdown chair 10 in FIG. 1. FIG. 3 also shows downward arrows along the direction of S-shaped arcuate arm support 22 indicating the downward absorption of force by bending of arcuate arm support 22. Therefore, the improved knockdown chair 10 is constructed so as to meet ASTM standard number F963 to resist force being exerted upon the child, which exceeds the typical force of a bouncing child upon improved knockdown chair 10.

FIG. 4 shows laminations 34 of the substantially S shaped reinforcing member 32 fabricated of wood laminations and held together in a resin or glue to promote flexure of S-shaped support bracket 32. In a further alternate embodiment, the wood laminations may contain one or more additional internal metal core laminate ply layers 34 between adjacent wooden laminate ply layers 34.

FIGS. 6-9 show an alternate embodiment of an improved knockdown chair 110, which is substantially the same as the improved knockdown chair 10, except that the improved knockdown chair 110 has substantially C shaped reinforcing members 132.

Figures 7, 8, 9:
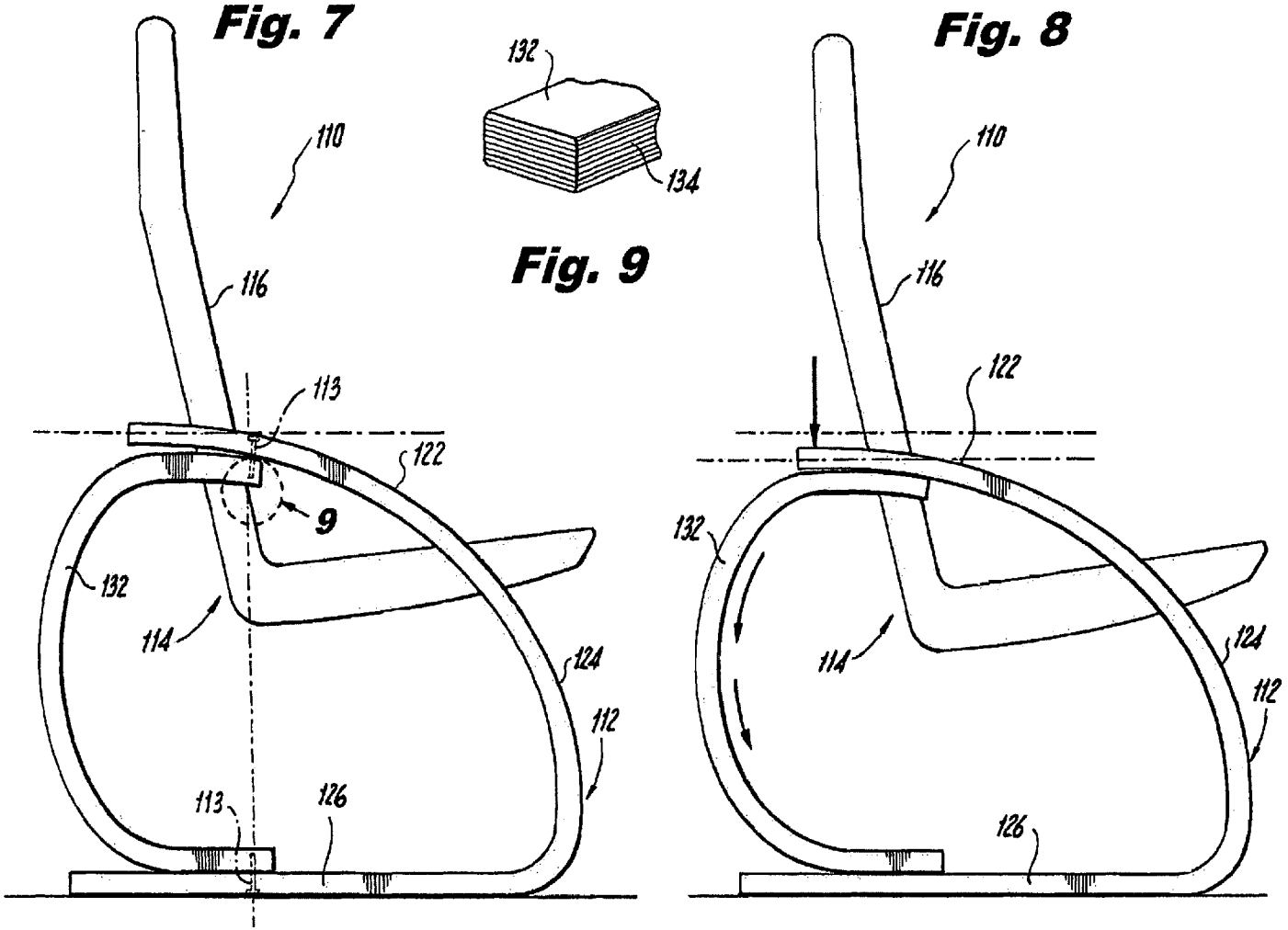
FIG. 7 is a side view of the alternate embodiment of the improved knockdown chair of FIG. 6.
FIG. 8 is a side view of the alternate embodiment of the improved knockdown chair of FIG. 6 showing the improved knockdown chair under load bearing conditions.
FIG. 9 is a perspective view of a corner of a reinforcing member of the alternate embodiment of the improved knockdown chair of FIG. 6 showing laminations of an alternate reinforcing member.

The improved knockdown chair 110 having opposing substantially C shaped support arms 112, a substantially L shaped tubular seating arrangement 114, a sock type seating portion cover 116, a front reinforcing member 118, and a bottom reinforcing member 120, wherein each of the opposing substantially C shaped support arms 112 are of laminate construction and have an upper arcuate arm support 122, a front arcuate portion 124, and a substantially straight bottom 126, the substantially L shaped tubular seating arrangement 114 having a tubular seat back 128 and a tubular sitting portion 130 telescopically interconnected one to the other, the sock type seating portion cover 116 removably fitted about the substantially L shaped tubular seating arrangement 114, and wherein each of the opposing substantially C shaped support arms 112 is opposingly removably fastened to the substantially L shaped tubular seating arrangement 114, the front reinforcing member 118 and the bottom reinforcing member 120 each removably fastened to and therebetween the opposing substantially C shaped support arms 112, wherein the improvement comprises the combination with each of the opposing substantially C shaped support arms 112 of an opposingly directed substantially C shaped reinforcing member 132 of laminate construction removably fastened to the upper arcuate arm support 122 and the substantially straight bottom 126 for reinforcing each of the opposing substantially C shaped support arms 112. FIG. 9 shows laminations 134 of the substantially C shaped reinforcing member 132. The child 36 is shown bouncing on the alternate embodiment of the improved knockdown chair 110 in FIG. 6.

Figure 6:
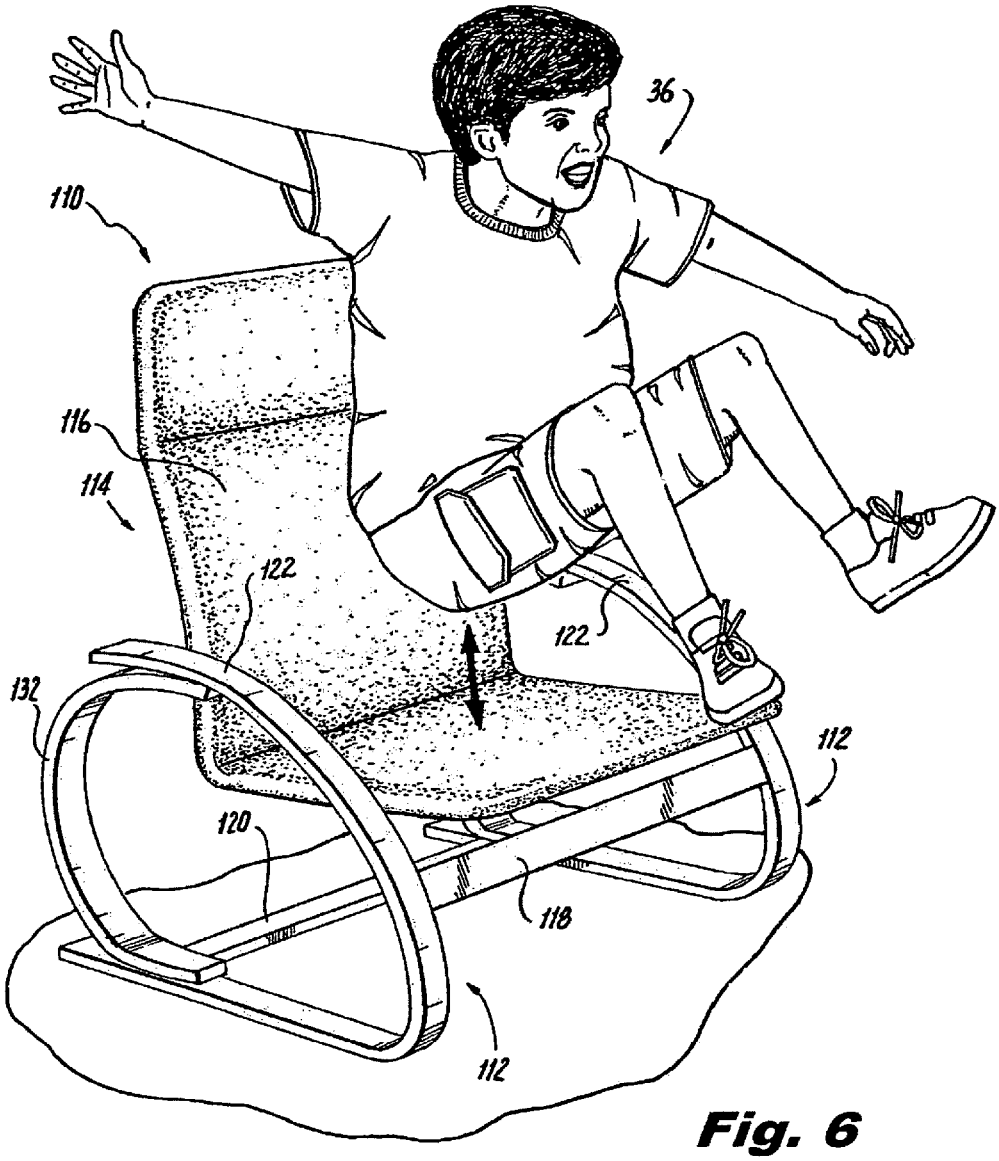
FIG. 6 is a perspective view of an alternate embodiment an of improved knockdown chair, constructed in accordance with the present invention, showing the child bouncing on the alternate embodiment of the improved knockdown chair.

Child 36 is shown bouncing on the improved knockdown chair 110 in FIG. 6.

FIG. 8 shows a maximum permissible deflection as indicated by the arrow and dashed lines as the arcuate arm support 122 bends in the amount shown in dashed lines, when subject to downward force, such as by child 36 jumping or bouncing on the improved knockdown chair 110 in FIG. 6. FIG. 8 also shows downward arrows along the direction of S-shaped arcuate arm support 122 indicating the downward absorption of force by bending of arcuate arm support 122. Therefore, the improved knockdown chair 110 is constructed so as to meet ASTM standard number F963 to resist force being exerted upon the child, which exceeds the typical force of a bouncing child upon improved knockdown chair 110.

FIG. 9 shows laminations 134 of the substantially C shaped reinforcing member 132 held together in a resin or glue to promote flexure of C-shaped support bracket. In a further alternate embodiment, the lamination may contain one or more internal metal core laminate ply layers 134 between adjacent wooden laminate ply layers 134.

Figure 10:
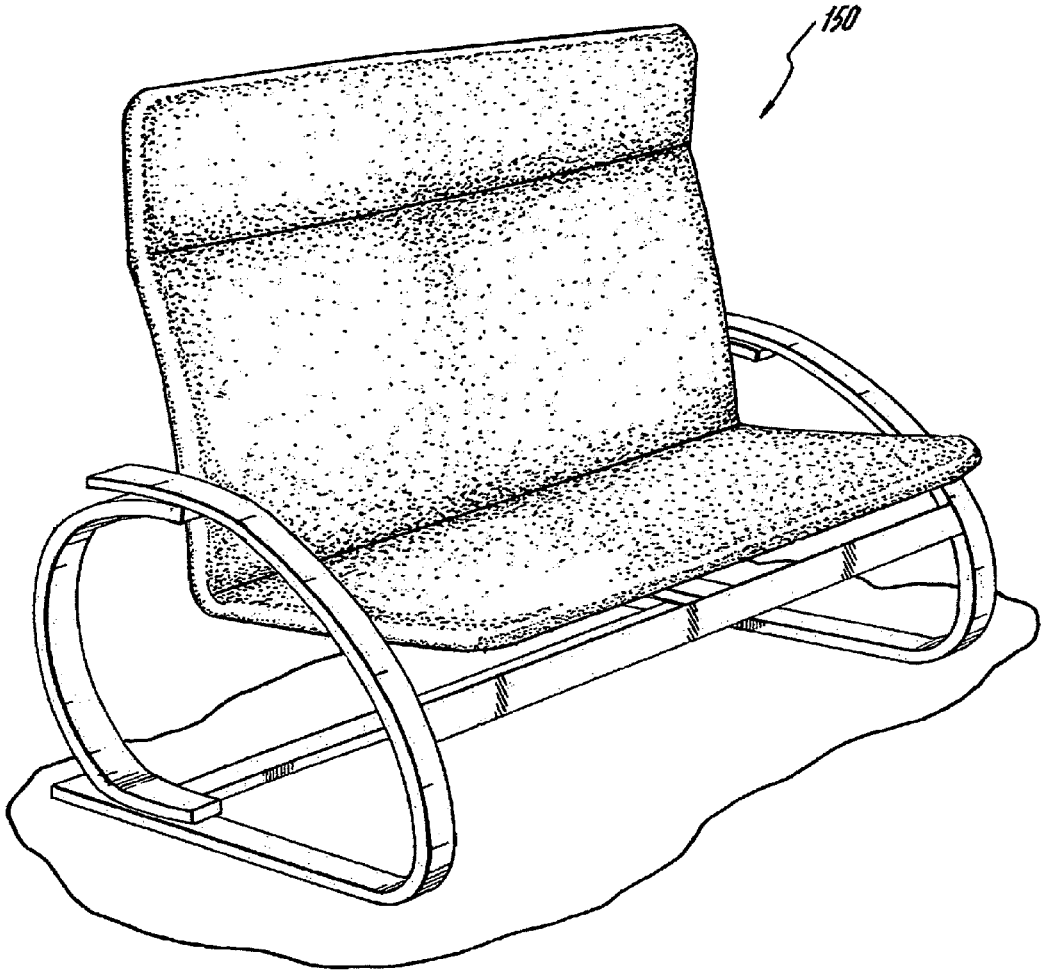
FIG. 10 is a perspective view of an improved knockdown sofa, constructed in accordance with the present invention.

FIG. 10 shows an embodiment of an improved knockdown sofa 150, which is substantially the same as the improved knockdown chair 110, except that the improved knockdown sofa 150 is wider than the improved knockdown chair 110.

Although the present invention has been described in considerable detail with reference to certain preferred versions thereof, other versions are possible. Therefore, the spirit and scope of the appended claims should not be limited to the description of the preferred versions contained herein.

What is claimed is:

1. A combination knockdown chair and support bracket for a child, said chair and bracket constructed to resist downward force, such as by a jumping or bouncing child, said chair and bracket comprising:

a substantially L-shaped combination seat and back, said seat having opposing first side members, said back having opposing second side members;

a pair of opposing substantially C-shaped wood laminate support members, each opposing substantially C-shaped wood laminate support member of said pair of opposing substantially C-shaped wood laminate support members comprising a plurality of longitudinally disposed wood laminations forming:

a substantially linear lower first sill in combination and continuous with a forwardly directed arcuate support section in combination and continuous with an upwardly directed upper arcuate arm section;

a pair of opposing substantially C-shaped wood laminate support brackets, each opposing substantially C-shaped wood laminate support bracket of said pair of opposing substantially C-shaped wood laminate support brackets comprising a plurality of longitudinally disposed wood laminations forming:

a substantially linear lower second sill in combination and continuous with a rearwardly directed arcuate mid section in combination and continuous with an upper arm support section;

a forwardly disposed connecting member having opposing first ends;

a lower connecting member having opposing second ends;

each said upwardly directed upper arcuate arm section releasably fastened to an opposing second side member of said opposing second side members;

each said forwardly directed arcuate support section releasably fastened to an opposing first side member of said opposing first side members;

each said substantially linear lower second sill releasably fastened to an opposing said substantially linear lower first sill;

each said upper arm support section releasably fastened to an opposing said upwardly directed upper arcuate arm section;

each first end of said opposing first ends releasably fastened to an opposing said forwardly directed arcuate support section;

each second end of said opposing second ends releasably fastened to a said opposing said substantially linear lower first sill.

2. The combination knockdown chair and support bracket for a child, said chair and bracket constructed to resist downward force, such as by a jumping or bouncing child, said chair and bracket as in claim 1, wherein:

said opposing first side members are substantially parallel and of tubular construction;

said opposing second side members are substantially parallel and of tubular construction;

said back comprises a tubular back frame, comprising:

said opposing first side members;

an upper tubular member continuous with and substantially perpendicular to said opposing first side members;

a lower tubular member connected to and substantially perpendicular to said opposing first side members;

substantially parallel opposing tubular partial seat members substantially perpendicular to and continuous with said opposing first side members;

said seat comprises a substantially U-shaped tubular seat frame, comprising:

said opposing second side members;

a forwardly disposed tubular member continuous with and substantially perpendicular to said opposing second side members;

said substantially parallel opposing tubular partial seat members and said opposing second side members adapted to removably mate one with the other.

3. The combination knockdown chair and support bracket for a child, said chair and bracket constructed to resist downward force, such as by a jumping or bouncing child, said chair and bracket as in claim 2, wherein:

said substantially L-shaped combination seat and back further comprises a fabric covering adapted to removably and matingly fit about said substantially L-shaped combination seat and back.

4. In a knockdown chair and bracket for a child, said chair and bracket constructed to resist downward force, such as by a jumping or bouncing child, said chair and bracket , having a substantially L-shaped combination seat and back; a pair of first substantially C-shaped support members each comprising a lower linear sill brace in combination with an arcuate forward arm portion; said back of said combination L-shaped seat and back fastened to a respective rear of each said arcuate forward arm portion and each said seat of said combination L-shaped seat and back fastened to a respective front of said arcuate forward arm portion; said L-shaped seat and back having a set of interconnected frame posts; wherein the improvements comprise:

a pair of said substantially C-shaped resilient rear supports each having a lower front distal mini-sill, a middle bowed portion directed toward a rear of said arcuate forward arm portion, each said middle bowed portion extending up from each said lower front distal mini-sill and ending in a respective upper front distal non-linear mini-sill connected by a respective first fastener connecting said respective upper front distal non-linear mini-sill of each said second substantially C-shaped resilient rear support to each said first substantially C-shaped support member;

each said lower rear distal linear mini-sill of each said substantially C-shaped resilient rear support being connected by a respective second fastener to each said lower linear sill brace of each said substantially C-shaped support member; and, each said first fastener and each said second fastener connecting each said lower rear distal linear mini-sill of each said substantially C-shaped resilient rear support to each said lower linear sill brace of each said substantially C-shaped support member being substantially vertically aligned with each other.

5. The improvements in a knockdown chair for a child, said chair and bracket constructed to resist downward force, such as by a jumping or bouncing child, said chair and bracket as in claim 4 wherein said pair of substantially C-shaped resilient rear supports are wooden.

6. The improvements in a knockdown chair for a child, said chair and bracket constructed to resist downward force, such as by a jumping or bouncing child, said chair and bracket as in claim 4 wherein said pair of substantially C-shaped resilient rear supports are metal.

7. The improvements in a knockdown chair for a child, said chair and bracket constructed to resist downward force, such as by a jumping or bouncing child, said chair and bracket as in claim 4 wherein said pair of substantially C-shaped resilient members are laminated.

8. The improvements in a knockdown chair for a child, said chair and bracket constructed to resist downward force, such as by a jumping or bouncing child, said chair and bracket as in claim 7 wherein said pair of substantially C-shaped resilient members have at least one internal metal laminate between adjacent wooden laminates.

9. The improvements in a knockdown chair for a child, said chair and bracket constructed to resist downward force, such as by a jumping or bouncing child, said chair and bracket as in claim 4 wherein said interconnected frame posts are solid members.

10. The improvements in a knockdown chair for a child, said chair and bracket constructed to resist downward force, such as by a jumping or bouncing child, said chair and bracket as in claim 4 wherein said interconnected frame posts are hollow tubular members.

* * * * *